US009488391B2

(12) United States Patent
Xu

(10) Patent No.: US 9,488,391 B2
(45) Date of Patent: Nov. 8, 2016

(54) CRYOGENIC REFRIGERATOR

(75) Inventor: Mingyao Xu, Tokyo (JP)

(73) Assignee: SUMITOMO HEAVY INDUSTRIES, LTD., Tokyo (JP)

( * ) Notice: Subject to any disclaimer, the term of this patent is extended or adjusted under 35 U.S.C. 154(b) by 321 days.

(21) Appl. No.: 13/606,111

(22) Filed: Sep. 7, 2012

(65) Prior Publication Data

US 2013/0081411 A1 Apr. 4, 2013

(30) Foreign Application Priority Data

Sep. 30, 2011 (JP) ..... 2011-218392

(51) Int. Cl.
*F25B 9/00* (2006.01)
*F25B 9/14* (2006.01)

(52) U.S. Cl.
CPC ..... *F25B 9/145* (2013.01); *F25B 9/14* (2013.01); *F25B 2309/1408* (2013.01); *F25B 2309/1418* (2013.01); *F25B 2309/1424* (2013.01); *F25B 2309/14181* (2013.01); *F25B 2309/14241* (2013.01)

(58) Field of Classification Search
CPC ..... F25B 9/145; F25B 2309/1424; F25B 2309/14241; F25B 2309/1418; F25B 2309/14181; F25B 2309/1408
USPC ..... 62/6
See application file for complete search history.

(56) References Cited

U.S. PATENT DOCUMENTS 5,335,505 A * 8/1994 Ohtani et al. ..... 62/6
5,927,081 A * 7/1999 Li ..... 62/6
6,256,998 B1 * 7/2001 Gao ..... F25B 9/145 62/6
6,434,947 B2 * 8/2002 Zhu ..... 60/520
6,629,418 B1 * 10/2003 Gao ..... F25B 9/145 60/520
8,783,045 B2 * 7/2014 Xu et al. ..... 62/6
2005/0115247 A1 * 6/2005 Gao ..... F25B 9/145 62/6
2008/0092588 A1 * 4/2008 Xu ..... F25B 9/14 62/600

FOREIGN PATENT DOCUMENTS

| | | |
|---|---|---|
| JP | 10-232057 | 9/1998 |
| JP | 11-351686 | 12/1999 |
| JP | 2000-230754 | 8/2000 |
| JP | 2001-272126 | 10/2001 |
| JP | 2001-317827 | 11/2001 |
| JP | 2008-527308 | 7/2008 |

* cited by examiner

*Primary Examiner* — Keith Raymond
(74) *Attorney, Agent, or Firm* — IPUSA, PLLC

(57) ABSTRACT

A cryogenic refrigerator includes a refrigerator body configured to produce cold temperatures by expanding a refrigerant gas; a compressor connected to a first pipe for feeding the refrigerant gas of a first pressure to the refrigerator body, and connected to a second pipe for collecting the refrigerant gas of a second pressure lower than the first pressure from the refrigerator body; a buffer tank configured to store the refrigerant gas; a first valve provided in a first connecting pipe connecting the buffer tank and the refrigerator body; a second valve provided in a second connecting pipe connecting the buffer tank and the first pipe; and a third valve provided in a third connecting pipe connecting the buffer tank and the second pipe.

3 Claims, 11 Drawing Sheets

CRYOGENIC REFRIGERATOR

CROSS-REFERENCE TO RELATED APPLICATION

This application is based upon and claims the benefit of priority of the prior Japanese Patent Application No. 2011-218392, filed on Sep. 30, 2011, the entire contents of which are incorporated herein by reference.

BACKGROUND OF THE INVENTION

1. Field of the Invention

The present invention generally relates to cryogenic refrigerators, and more particularly to a cryogenic refrigerator including a compressor configured to feed a refrigerant gas.

2. Description of the Related Art

Cryogenic refrigerators such as Gifford-McMahon refrigerators (hereinafter referred to as "GM refrigerators") and pulse tube refrigerators include a compressor configured to compress and increase the pressure of a low-pressure refrigerant gas collected from a cylinder or a regenerator (hereinafter referred to as "cylinder or the like") and to re-feed the high-pressure (compressed) refrigerant gas to the cylinder or the like.

Further, a cryogenic refrigerator has been proposed that includes an intermediate buffer tank in order to reduce the size and the output of the compressor. (See Japanese National Publication of International Patent Application No. 2008-527308.) This cryogenic refrigerator is configured to feed a refrigerant gas stored in the intermediate buffer tank to the cylinder or the like before feeding a high-pressure refrigerant gas from the compressor to the cylinder or the like.

SUMMARY OF THE INVENTION

According to an aspect of the present invention, a cryogenic refrigerator includes a refrigerator body configured to produce cold temperatures by expanding a refrigerant gas; a compressor connected to a first pipe for feeding the refrigerant gas of a first pressure to the refrigerator body, and connected to a second pipe for collecting the refrigerant gas of a second pressure lower than the first pressure from the refrigerator body; a buffer tank configured to store the refrigerant gas; a first valve provided in a first connecting pipe connecting the buffer tank and the refrigerator body; a second valve provided in a second connecting pipe connecting the buffer tank and the first pipe; and a third valve provided in a third connecting pipe connecting the buffer tank and the second pipe.

The object and advantages of the embodiments will be realized and attained by means of the elements and combinations particularly pointed out in the claims.

It is to be understood that both the foregoing general description and the following detailed description are exemplary and explanatory and not restrictive of the invention.

BRIEF DESCRIPTION OF THE DRAWINGS

Other objects, features and advantages of the present invention will become more apparent from the following detailed description when read in conjunction with the accompanying drawings, in which.

DETAILED DESCRIPTION OF THE PREFERRED EMBODIMENTS

As described above, the compressor provided in cryogenic refrigerators increases the pressure of a refrigerant gas collected from the low-pressure side and feeds the high-pressure (pressure-increased) refrigerant gas to the high-pressure side. However, if the compressor keeps on feeding the high-pressure refrigerant gas to the high-pressure side during a period in which the compressor feeds no refrigerant gas to the cylinder or the like, the pressure on the high-pressure side of the compressor significantly increases.

On the other hand, if the compressor keeps on feeding the high-pressure refrigerant gas to the high-pressure side during a period in which no refrigerant gas is collected from the cylinder or the like into the compressor, the pressure on the low-pressure side of the compressor significantly decreases.

Unfortunately, such a large difference between the high-pressure side and the low-pressure side of the compressor imposes an operational load on the compressor, thus reducing compression efficiency and increasing power consumption.

According to an aspect of the present invention, a cryogenic refrigerator is provided in which the pressure difference between the high-pressure side and the low-pressure side of a compressor is reduced.

A description is given below, with reference to the accompanying drawings, of embodiments of the present invention.

Figure 1:
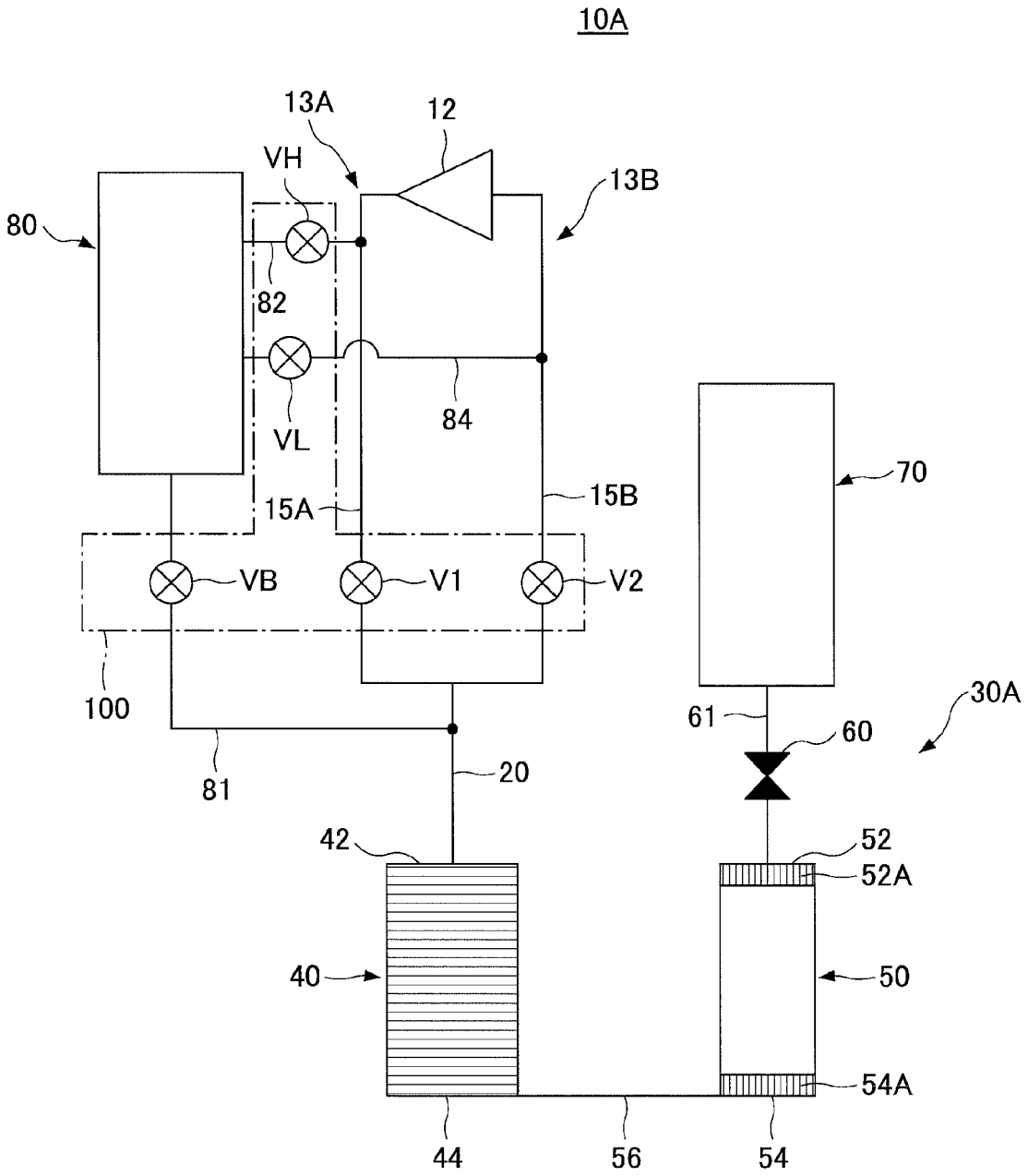
FIG. 1 is a diagram illustrating a cryogenic refrigerator according to a first embodiment of the present invention.

FIG. 1 is a diagram illustrating a cryogenic refrigerator 10A according to a first embodiment of the present invention. The cryogenic refrigerator 10A illustrated in FIG. 1 is an application of an embodiment of the present invention to a pulse tube refrigerator.

According to this embodiment, the cryogenic refrigerator 10A includes a compressor 12, a high-pressure-side refrigerant gas feed system 13A, a low-pressure-side refrigerant gas collection system 13B, a refrigerator body 30A, and a second buffer tank 80. The refrigerator body 30A includes a regenerator 40 such as a regenerator tube, a pulse tube 50, and a first buffer tank 70.

The high-pressure-side refrigerant gas feed system 13A is connected to the high-pressure (feed) side of the compressor 12, and feeds the refrigerator body 30A with a high-pressure refrigerant gas (for example, helium gas). Further, the low-pressure-side refrigerant gas collection system 13B is connected to the low-pressure (collection) side of the compressor 12, and collects a low-pressure refrigerant gas from the refrigerator body 30A.

The high-pressure-side refrigerant gas feed system 13A includes a first high-pressure-side pipe 15A and a first opening and closing valve V1. The first high-pressure-side pipe 15A has a first end connected to the high-pressure (feed) side of the compressor 12 and a second end connected to a first common pipe 20. The first common pipe 20 is connected to a high-temperature end 42 of the regenerator 40.

Further, the first opening and closing valve V1 is provided in the first high-pressure-side pipe 15A. The feeding of a refrigerant gas flowing through the first high-pressure-side pipe 15A to the regenerator 40 is started and stopped by opening and closing, respectively, the first opening and closing valve V1.

The low-pressure-side refrigerant gas collection system 13B includes a first low-pressure-side pipe 15B and a second opening and closing valve V2. The first low-pressure-side pipe 15B has a first end connected to the low-pressure (collection) side of the compressor 12 and a second end connected to the first common pipe 20.

Further, the second opening and closing valve V2 is provided in the first low-pressure-side pipe 15B. The collection of a refrigerant gas from the regenerator 40 into the compressor 12 through the first low-pressure-side pipe 15B is started and stopped by opening and closing, respectively, the second opening and closing valve V2.

The refrigerator body 30A forms a pulse-tube-type refrigerator. The refrigerator body 30A includes the regenerator 40, the pulse tube 50, and the first buffer tank 70.

The regenerator 40 is filled with a regenerator material. As described above, the first common pipe 20 is connected to the high-temperature end 42 of the regenerator 40. Further, a low-temperature end 44 of the regenerator 40 is connected to a low-temperature end 54 of the pulse tube 50 via a connecting pipe 56.

A high-temperature end 52 of the pulse tube 50 is connected to the first buffer tank 70 via a pipe 61 having an orifice 60. With the orifice 60 and the first buffer tank 70, it is possible to adjust the phase of the pressure change of a refrigerant gas flowing through the pulse tube 50, thus making it possible to improve refrigeration efficiency.

Further, a heat exchanger 52A and a heat exchanger 54A are provided at a high-temperature end and a low-temperature end, respectively, inside the pulse tube 50. The heat exchangers 52A and 54A exchange heat with a refrigerant gas to be cooled when the refrigerant gas passes through the heat exchangers 52A and 54A.

The second buffer tank 80 is so configured as to allow a refrigerant gas to be stored inside the second buffer tank 80. The second buffer tank 80 is connected to the first common pipe 20 via a second common pipe 81. Further, a buffer valve VB is provided in the second common pipe 81. The buffer valve VB is opened to allow a refrigerant gas to be fed to/from the second buffer tank 80 from/to the regenerator 40.

A high-pressure-side bypass pipe 82 is provided between the first high-pressure-side pipe 15A and the second buffer tank 80. Further, a high-pressure-side valve VH is provided in the high-pressure-side bypass pipe 82. The high-pressure-side valve VH is opened to allow the first high-pressure-side pipe 15A and the second buffer tank 80 to communicate with each other.

A low-pressure-side bypass pipe 84 is provided between the first low-pressure-side pipe 15B and the second buffer tank 80. Further, a low-pressure-side valve VL is provided in the low-pressure-side bypass pipe 84. The low-pressure-side valve VL is opened to allow the first low-pressure-side pipe 15B and the second buffer tank 80 to communicate with each other.

Figure 2:
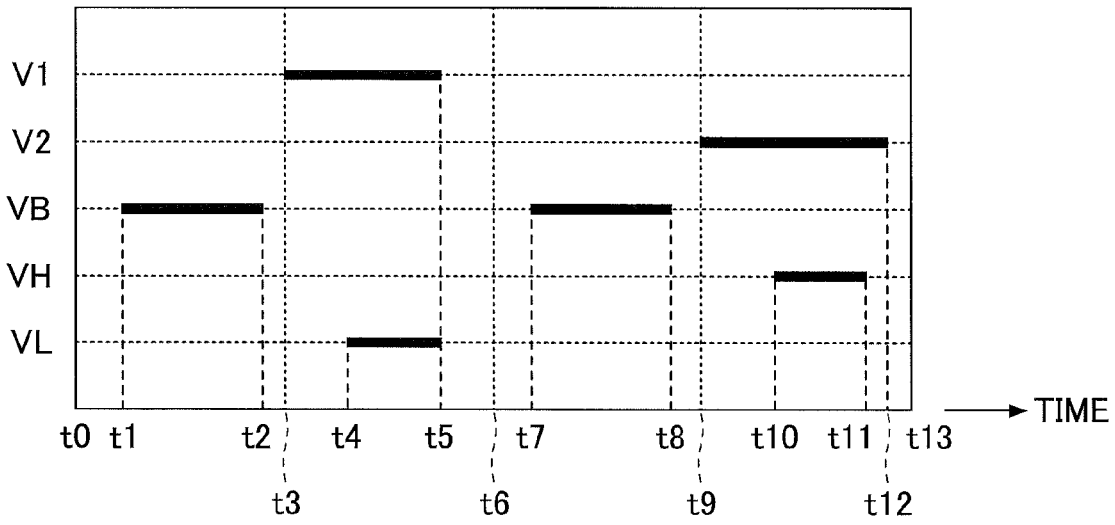
FIG. 2 is a timing chart illustrating opening and closing timing of valves of the cryogenic refrigerator according to the first embodiment of the present invention.
Figure 3:
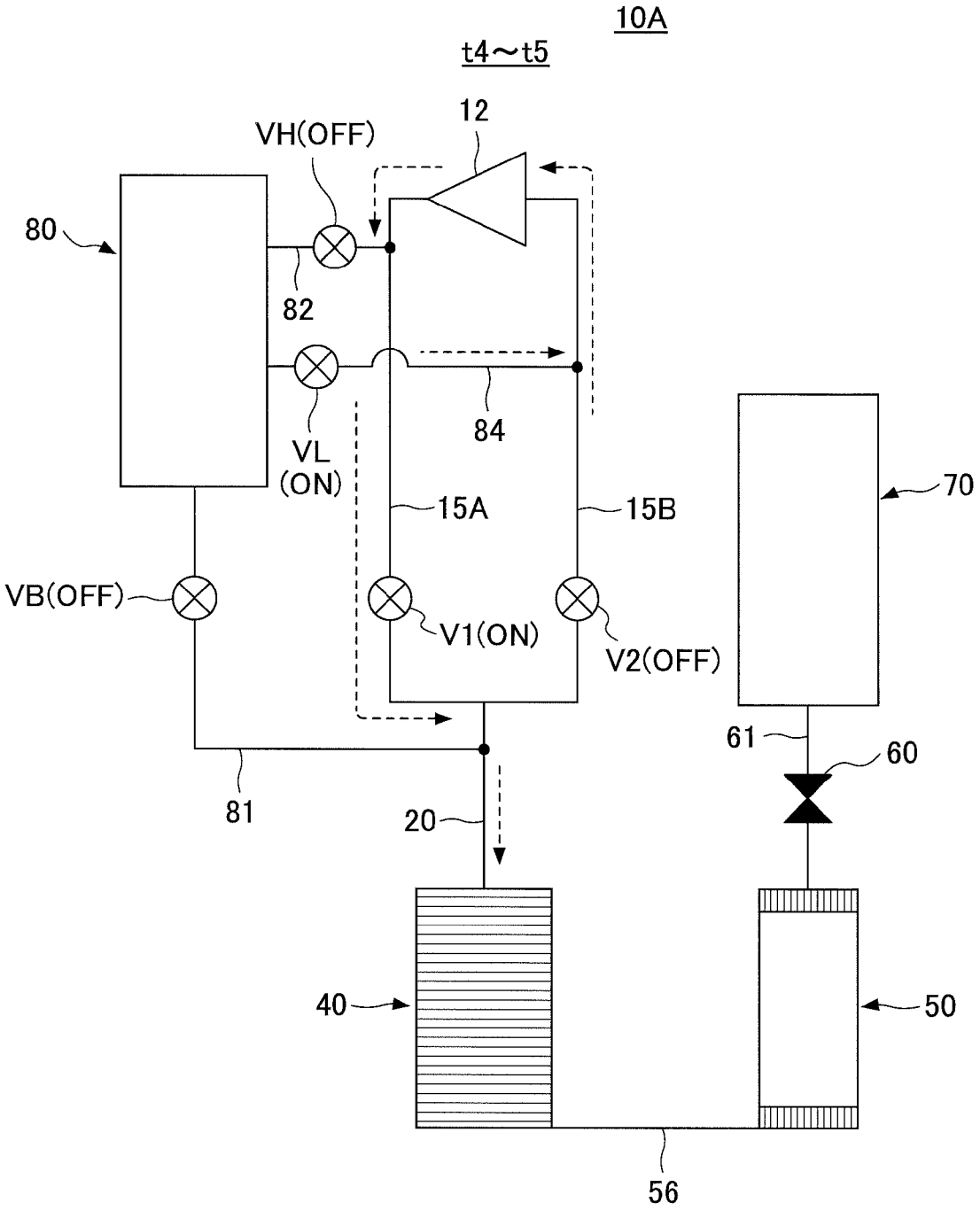
FIG. 3 is a diagram illustrating an operation of the cryogenic refrigerator according to the first embodiment of the present invention.
Figure 4:
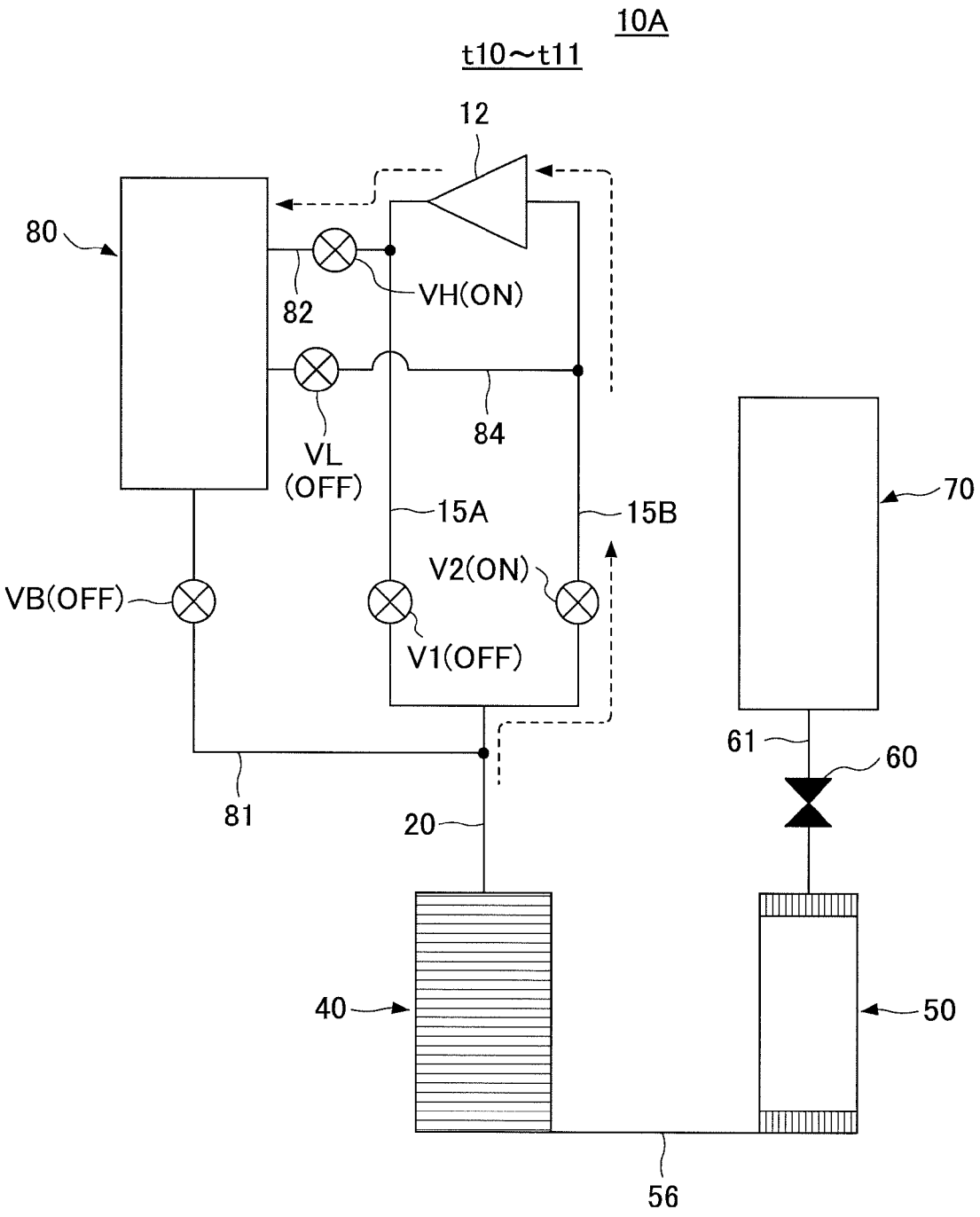
FIG. 4 is a diagram illustrating the operation of the cryogenic refrigerator according to the first embodiment of the present invention.

Next, a description is given, with reference to FIG. 2, FIG. 3 and FIG. 4, of an operation of the cryogenic refrigerator 10A of the above-described configuration.

FIG. 2 is a timing chart illustrating opening and closing timing of the valves V1, V2, VB, VH, and VL provided in the cryogenic refrigerator 10A. FIG. 3 is a diagram illustrating a state of the cryogenic refrigerator 10A between Time t4 and Time t5 in FIG. 2. FIG. 4 is a diagram illustrating a state of the cryogenic refrigerator 10A between Time t10 and Time t11 in FIG. 2.

The cryogenic refrigerator 10A includes a valve unit 100. The valve unit 100 includes the valves V1, V2, VB, VH, and VL, and controls the switching (opening and closing) of the valves V1, V2, VB, VH, and VL. The valve unit 100 may be configured by a controller and electromagnetic valves (corresponding to the valves V1, V2, VB, VH, and VL) or by a rotary valve that implements the valves V1, V2, VB, VH, and VL. For convenience of graphical representation, the valve unit 100 is not indicated in FIG. 3 and FIG. 4.

In FIG. 2, a period indicated by a bold solid line indicates the open state of a valve. Further, in FIG. 3 and FIG. 4, an open valve is indicated by "(ON)" and a closed valve is indicated by "(OFF)."

[First Process: Time t0 through Time t3]

As illustrated in FIG. 2, the buffer valve VB is opened from Time t1 to Time t2 in a refrigerant gas feed preliminary process of Time t0 through Time t3. Further, the other valves V1, V2, VH and VL are caused to remain closed.

A high-pressure refrigerant gas is stored in the second buffer tank 80 as described below. Accordingly, the buffer valve VB is opened to allow the high-pressure refrigerant gas in the second buffer tank 80 to be fed to the regenerator 40 through the second common pipe 81 and the first common pipe 20. The high-pressure refrigerant gas fed from the second buffer tank 80 to the regenerator 40 is fed to the pulse tube 50 through the regenerator 40 and the connecting pipe 56.

[Second Process: Time t3 through Time t6]

In a refrigerant gas feed process of Time t3 through Time t6, the first opening and closing valve V1 is opened from Time t3 to Time t5. Further, the second opening and closing valve V2, the buffer valve VB, and the high-pressure-side valve VH are caused to remain closed. As a result, a high-pressure refrigerant gas compressed in the compressor 12 is fed to the regenerator 40 through the first high-pressure-side pipe 15A and the first common pipe 20.

As described above, according to the cryogenic refrigerator 10A of this embodiment, a high-pressure refrigerant gas is fed from the second buffer tank 80 to the regenerator 40 before the feeding of a high-pressure refrigerant gas from the compressor 12 to the regenerator 40. Therefore, compared with the case of feeding a high-pressure refrigerant gas to the regenerator 40 and the pulse tube 50 using only the compressor 12, it is possible to reduce the amount of gas fed from the compressor 12, so that it is possible to reduce the output and the power consumption of the compressor 12.

In the low-pressure-side refrigerant gas collection system 13B (FIG. 1), the second opening and closing valve V2 is closed, and the compressor 12 collects a low-pressure refrigerant gas from the first low-pressure-side pipe 15B and feeds the collected refrigerant gas to the high-pressure-side refrigerant gas feed system 13A (FIG. 1). As a result, the pressure inside the first low-pressure-side pipe 15B is reduced. Therefore, leaving this state would result in an increase in the pressure difference between the high-pressure side and the low-pressure side of the compressor 12 as in the conventional case.

However, according to the cryogenic refrigerator 10A of this embodiment, the second buffer tank 80 and the first low-pressure-side pipe 15B are connected by the low-pressure-side bypass pipe 84. Further, the low-pressure-side valve VL provided in the low-pressure-side bypass pipe 84 is opened at Time t4 after passage of a predetermined time since the opening of the first opening and closing valve V1 as illustrated in FIG. 2.

Therefore, the low-pressure-side valve VL is opened from Time t4 to Time t5 to cause a high-pressure refrigerant gas in the second buffer tank 80 to flow into the first low-pressure-side pipe 15B through the low-pressure-side bypass pipe 84 as illustrated in FIG. 3 (in which a broken line arrow indicates a flow of a refrigerant gas). Accordingly, even with the compressor 12 collecting a refrigerant gas from the first low-pressure-side pipe 15B, a high-pressure refrigerant gas is fed from the second buffer tank 80 to the first low-pressure-side pipe 15B to prevent the pressure inside the first low-pressure-side pipe 15B from being reduced.

[Third Process: Time t6 through Time t9]

In a refrigerant gas collection preliminary process of Time t6 through Time t9, the buffer valve VB is opened from Time t7 to Time t8. Further, the other valves V1, V2, VH, and VL are caused to remain closed.

As a result, the refrigerant gas inside the regenerator 40 and the pulse pipe 50 is collected into the second buffer tank 80 through the connecting pipe 56, the first common pipe 20, and the second common pipe 81. As a result, the pressure of a refrigerant gas inside the second buffer tank 80 increases.

[Fourth Process: Time t9 through Time t13]

In a refrigerant gas collection process of Time t9 through Time t13, the second opening and closing valve V2 is opened from Time t9 through Time t12. Further, the first opening and closing valve V1, the buffer valve VB, and the low-pressure-side valve VL are caused to remain closed.

As a result, the refrigerant gas inside the pulse tube 50 is collected into the compressor 12 through the connecting pipe 56, the regenerator 40, the first common pipe 20, and the first low-pressure-side pipe 15B. Further, the collected refrigerant gas is compressed in the compressor 12, so that the high-pressure refrigerant gas is fed to the first high-pressure-side pipe 15A.

As described above, according to the cryogenic refrigerator 10A of this embodiment, the refrigerant gas is collected into the second buffer tank 80 before the compressor 12 starts to collect the refrigerant gas from the pulse tube 50 and the regenerator 40. Therefore, compared with the case of collecting a refrigerant gas only with the compressor 12, it is possible to reduce the amount of gas collected with the compressor 12, so that it is possible to reduce the output and the power consumption of the compressor 12.

In the high-pressure-side refrigerant gas collection system 13A (FIG. 1), the first opening and closing valve V1 is closed, and the compressor 12 collects a low-pressure refrigerant gas from the first low-pressure-side pipe 15B and feeds the collected refrigerant gas to the high-pressure-side refrigerant gas feed system 13A. As a result, the pressure inside the first high-pressure-side pipe 15A increases. Therefore, leaving this state would result in an increase in the pressure difference between the high-pressure side and the low-pressure side of the compressor 12 as described above.

However, according to the cryogenic refrigerator 10A of this embodiment, the second buffer tank 80 and the first high-pressure-side pipe 15A are connected by the high-pressure-side bypass pipe 82. Further, the high-pressure-side valve VH provided in the high-pressure-side bypass pipe 82 is opened at Time t10 after passage of a predetermined time since the opening of the second opening and closing valve V2 as illustrated in FIG. 2.

Therefore, the high-pressure-side valve VH is opened from Time t10 to Time t11 to cause the high-pressure refrigerant gas generated in the compressor 12 to flow into the second buffer tank 80 through the high-pressure-side bypass pipe 82 as illustrated in FIG. 4 (in which a broken line arrow indicates a flow of a refrigerant gas). Accordingly, even with the compressor 12 feeding a high-pressure refrigerant gas to the first high-pressure-side pipe 15A with the first opening and closing valve V1 closed, the high-pressure refrigerant gas is fed to the second buffer tank 80 to prevent the pressure inside the first high-pressure-side pipe 15A from increasing.

By repeatedly performing the above-described first through fourth processes as one cycle, a refrigerant gas is repeatedly compressed and expanded in the pulse tube 50, so that it is possible to produce cold temperatures at the low-temperature end 54 (FIG. 1) of the pulse tube 50.

Further, as described above, according to the cryogenic refrigerator 10A of this embodiment, in a period during which no refrigerant gas is fed from the compressor 12 to the refrigerator body 30A with the first opening and closing valve V1 being closed, the high-pressure-side valve VH is opened to connect the first high-pressure-side pipe 15A connected to the compressor 12 to the second buffer tank 80, so that a high-pressure refrigerant gas is fed from the compressor 12 to the second buffer tank 80.

Further, in a period during which no refrigerant gas is collected from the refrigerator body 30A by the compressor 12 with the second opening and closing valve V2 being closed, the low-pressure-side valve VL is opened to connect the first low-pressure-side pipe 15B connected to the compressor 12 to the second buffer tank 80, so that a high-pressure refrigerant gas is fed from the second buffer tank 80 to the first low-pressure-side pipe 15B.

The above-described configuration makes it possible to prevent the pressure of the high-pressure-side refrigerant gas feed system 13A on the high-pressure side of the compressor 12 from increasing in a period during which no refrigerant gas is fed from the compressor 12 to the refrigerator body 30A. Further, the above-described configuration makes it possible to prevent the pressure of the compressor 12 from being reduced in a period during which no refrigerant gas is collected from the refrigerator body 30A by the compressor 12. As a result, it is possible to reduce a pressure difference between the high-pressure side and the low-pressure side of the compressor 12.

Further, as a result of reduction in the pressure difference between the high-pressure side and the low-pressure side of the compressor 12, it is possible to reduce an operational load on the compressor 12, so that it is possible to reduce the power consumption of the compressor 12. Further, it is possible to stabilize a refrigerant gas fed to and collected from the refrigerator body 30A, so that it is possible to improve the refrigeration efficiency of the refrigerator body 30A.

Next, a description is given, with reference to FIG. 5 through FIG. 11, of other embodiments of the present invention.

In FIG. 5 through FIG. 11, the same elements as or elements corresponding to those of the cryogenic refrigerator 10A of the first embodiment described using FIG. 1 through FIG. 4 are referred to by the same reference numerals, and a description thereof is omitted.

Figure 5:
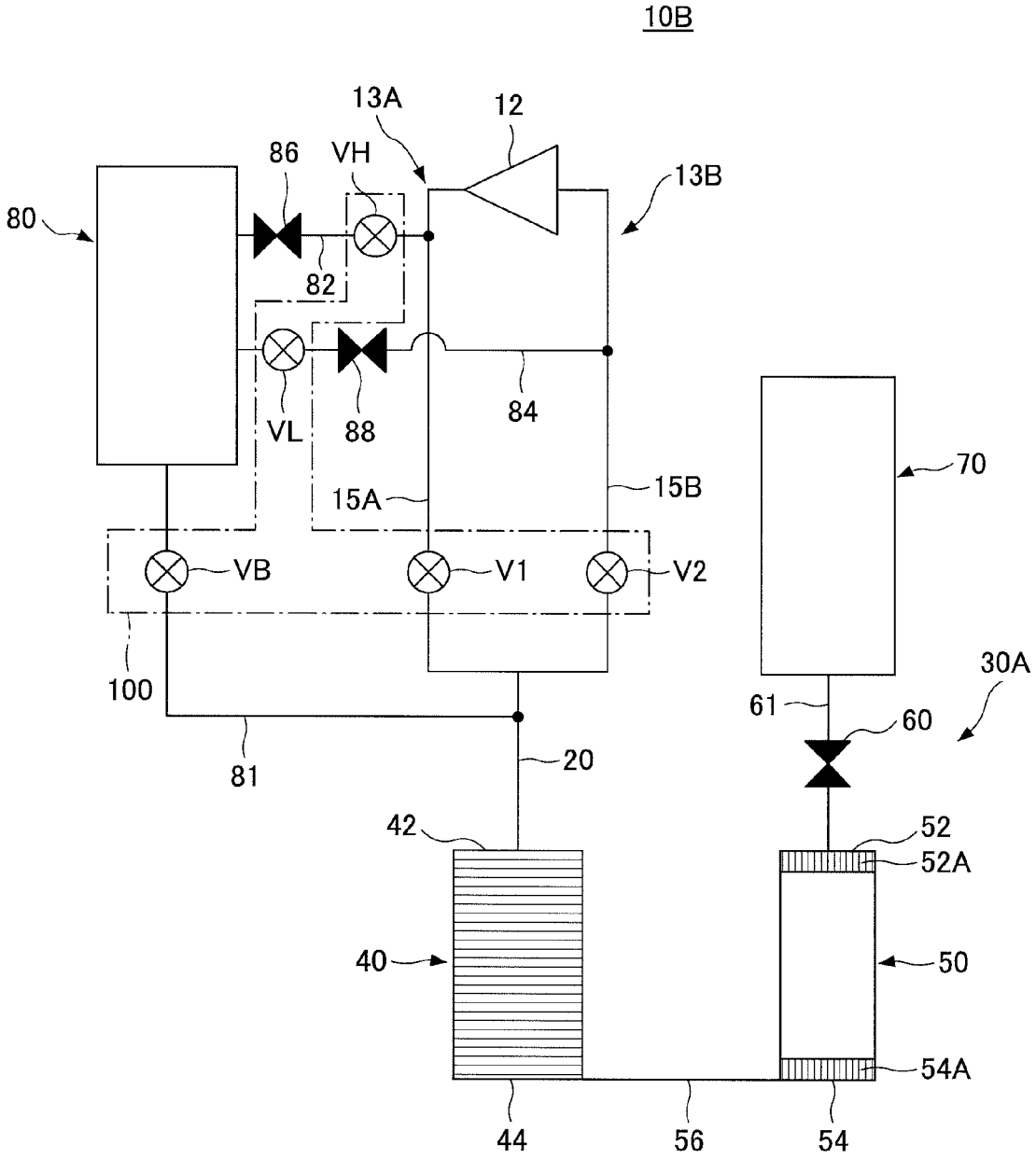
FIG. 5 is a diagram illustrating a cryogenic refrigerator according to a second embodiment of the present invention.

FIG. 5 is a diagram illustrating a cryogenic refrigerator 10B according to a second embodiment of the present invention.

The cryogenic refrigerator 10B of this embodiment may have the same configuration as the cryogenic refrigerator 10A of the first embodiment except for further including a high-pressure-side orifice 86 provided in the high-pressure-side bypass pipe 82 and a low-pressure-side orifice 88 provided in the low-pressure-side bypass pipe 84. The high-pressure-side orifice 86 controls the flow rate of a refrigerant gas flowing through the high-pressure-side bypass pipe 82. The low-pressure-side orifice 88 controls the flow rate of a refrigerant gas flowing through the low-pressure-side bypass pipe 84.

In a period during which no refrigerant gas is fed from the compressor 12 to the refrigerator body 30A, the high-pressure-side valve VH is opened to feed a high-pressure refrigerant gas from the compressor 12 to the second buffer tank 80 as described above. The high-pressure-side orifice 86 controls the flow rate of the refrigerant gas flowing through the high-pressure-side bypass pipe 82, thereby controlling passage of the refrigerant gas from the first high-pressure-side pipe 15A to the second buffer tank 80.

In a period during which no refrigerant gas is collected from the refrigerator body 30A by the compressor 12, the low-pressure-side valve VL is opened to feed a high-pressure refrigerant gas from the second buffer tank 80 to the first low-pressure-side pipe 15B as described above. The low-pressure-side orifice 88 controls the flow rate of the refrigerant gas flowing through the low-pressure-side bypass pipe 84, thereby controlling passage of the refrigerant gas from the second buffer tank 80 to the first low-pressure-side pipe 15B.

Therefore, according to the cryogenic refrigerator 10B of this embodiment, the flow rate of a refrigerant gas is controlled in a direction from the first high-pressure-side pipe 15A to the second buffer tank 80 and in a direction from the second buffer tank 80 to the first low-pressure-side pipe 15B. As a result, it is possible to stabilize the internal pressure of the first high-pressure-side pipe 15A and the internal pressure of the first low-pressure-side pipe 15B. This also makes it possible to reduce the power consumption of the compressor 12 and to improve the refrigeration efficiency of the refrigerator body 30A.

Figure 6:
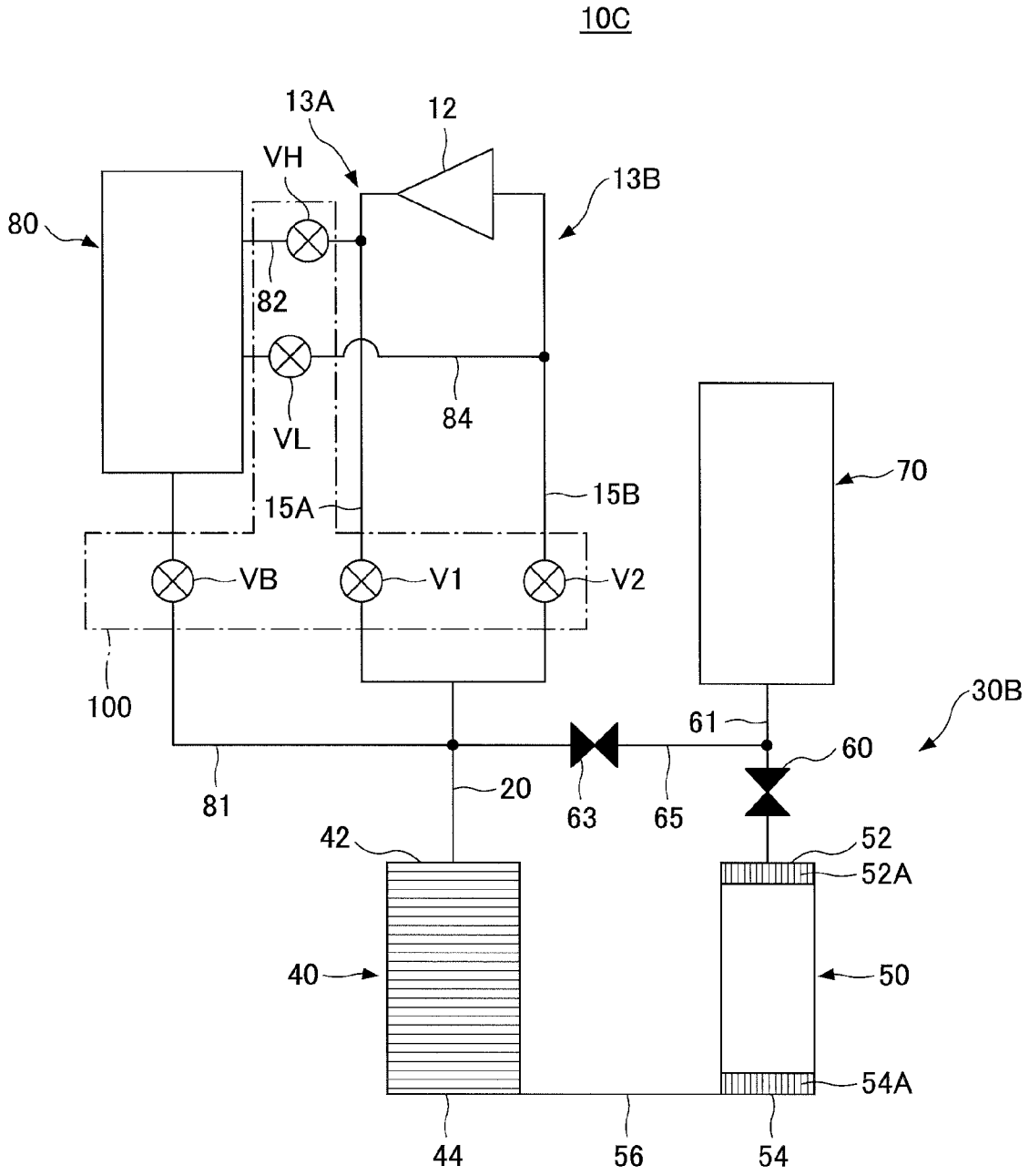
FIG. 6 is a diagram illustrating a cryogenic refrigerator according to a third embodiment of the present invention.

FIG. 6 is a diagram illustrating a cryogenic refrigerator 10C according to a third embodiment of the present invention.

The cryogenic refrigerator 10C of this embodiment may have the same configuration of the cryogenic refrigerator 10A of the first embodiment except for including a refrigerator body 30B in place of the refrigerator body 30A of the first embodiment. A pulse tube refrigerator of a double inlet type is applied as the refrigerator body 30B. Accordingly, the refrigerator body 30B includes a double inlet valve 63 and a double inlet pipe 65 in addition to the configuration of the refrigerator body 30A of the first embodiment.

The double inlet pipe 65 is provided between the pipe 61, which connects the pulse tube 50 and the first buffer tank 70, and the first common pipe 20. Further, the double inlet valve 63 is provided in the double inlet pipe 65.

According to the cryogenic refrigerator 10C of the above-described configuration, it is possible to control a phase difference between the compression and expansion of a refrigerant gas inside the pulse tube 50 not only with the orifice 60 and the first buffer tank 70 but also with the double inlet valve 63, so that it is possible to improve refrigeration efficiency.

Further, the cryogenic refrigerator 10C including the double-inlet-type refrigerator body 30B with the double inlet valve 63 and the double inlet pipe 65 may also include the high-pressure-side valve VH, the low-pressure-side valve VL, the second buffer tank 80, the high-pressure-side bypass pipe 82, and the low-pressure-side bypass pipe 84, so that it is possible to reduce the power consumption of the compressor 12 and to improve the refrigeration efficiency of the refrigerator body 30B.

Figure 7:
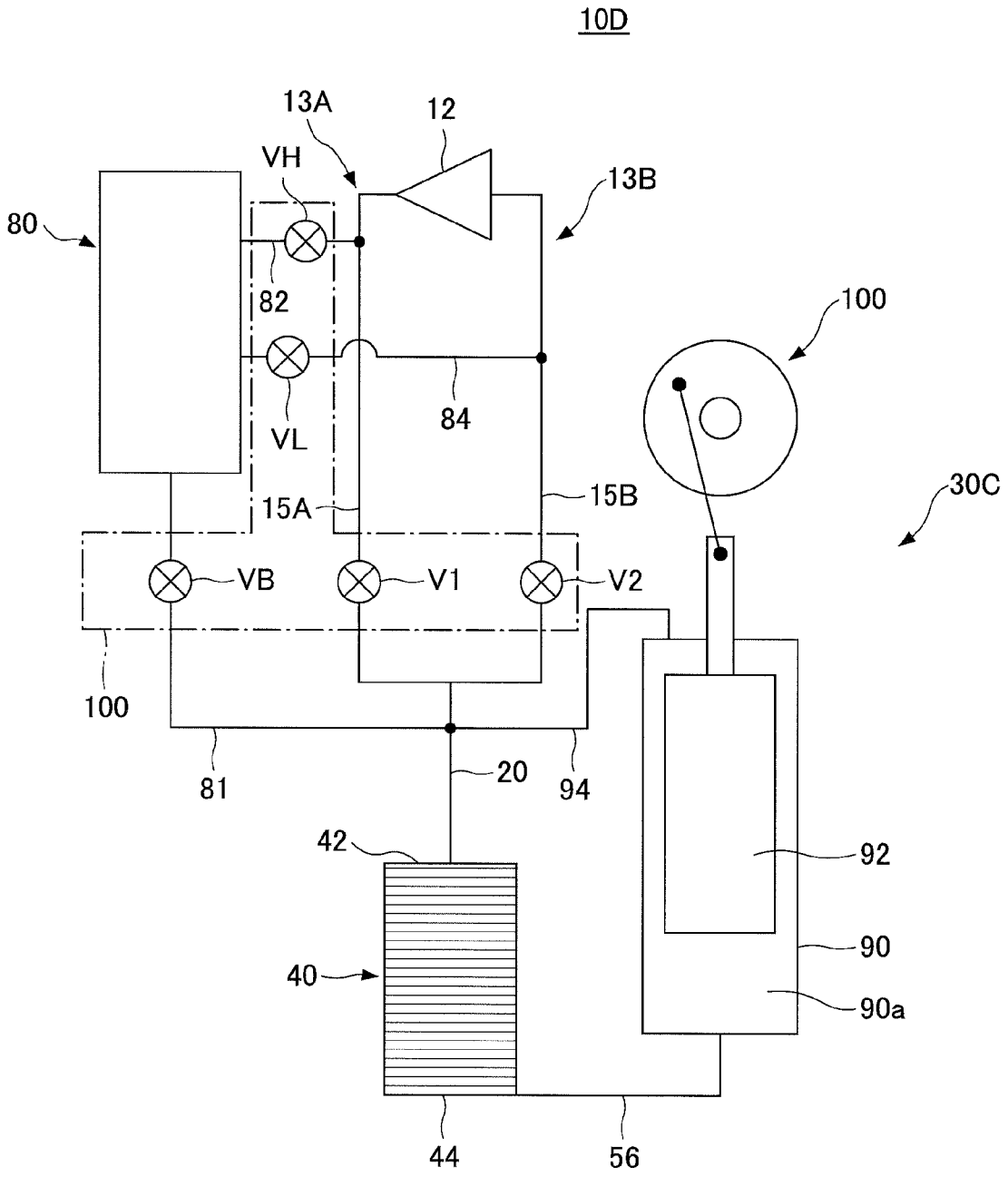
FIG. 7 is a diagram illustrating a cryogenic refrigerator according to a fourth embodiment of the present invention.

FIG. 7 is a diagram illustrating a cryogenic refrigerator 10D according to a fourth embodiment of the present invention.

The cryogenic refrigerator 10D of this embodiment may have the same configuration of the cryogenic refrigerator 10A of the first embodiment except for including a refrigerator body 30C in place of the refrigerator body 30A of the first embodiment. A GM refrigerator is applied as the refrigerator body 30C.

The refrigerator body 30C includes the regenerator 40, a cylinder 90, a displacer 92, and a drive mechanism 100. The connecting pipe 56 is connected to the lower end part of the cylinder 90. A pipe 94 is connected to the upper end part of the cylinder 90. The pipe 94 connects the upper end part of the cylinder 90 and the first common pipe 20.

The displacer 92 is configured to move up and down inside the cylinder 90. Further, an expansion chamber 90*a* is formed at a position below the displacer 92 inside the cylinder 90. Further, a sealing material (not graphically illustrated) is provided between the cylinder 90 and the displacer 92 so as to prevent a high-pressure refrigerant gas from leaking out from between the cylinder 90 and the displacer 92.

The displacer 92 is connected to the drive mechanism 100. The drive mechanism 100 is, for example, a Scotch yoke mechanism, and converts the rotation of a motor into a vertical linear motion of the displacer 92. The displacer 92 is driven by the drive mechanism 100 to vertically reciprocate inside the cylinder 90.

The refrigerator body 30C of the above-described configuration operates as follows. First, the first opening and closing valve V1 is opened to cause a high-pressure refrigerant gas to be fed to the cylinder 90. Further, the displacer 92, which is driven by the drive mechanism 100, moves toward its top dead end.

When the expansion chamber 90*a* reaches its maximum capacity, the first opening and closing valve V1 is closed and the second opening and closing valve V2 is opened. As a result, the refrigerant gas inside the expansion chamber 90*a* adiabatically expands to produce cold temperatures.

Thereafter, the displacer 92, which is driven by the drive mechanism 100, moves toward its bottom dead end, so that the refrigerant gas inside the cylinder 90 is collected into the compressor 12 through the connecting pipe 56, the regenerator 40, and the first low-pressure-side pipe 15B.

The cryogenic refrigerator 10C including the GM-type refrigerator body 30C of the above-described configuration as well may include the high-pressure-side valve VH, the low-pressure-side valve VL, the second buffer tank 80, the high-pressure-side bypass pipe 82, and the low-pressure-side bypass pipe 84, so that it is possible to reduce the power consumption of the compressor 12 and to improve the refrigeration efficiency of the refrigerator body 30C.

Figure 8:
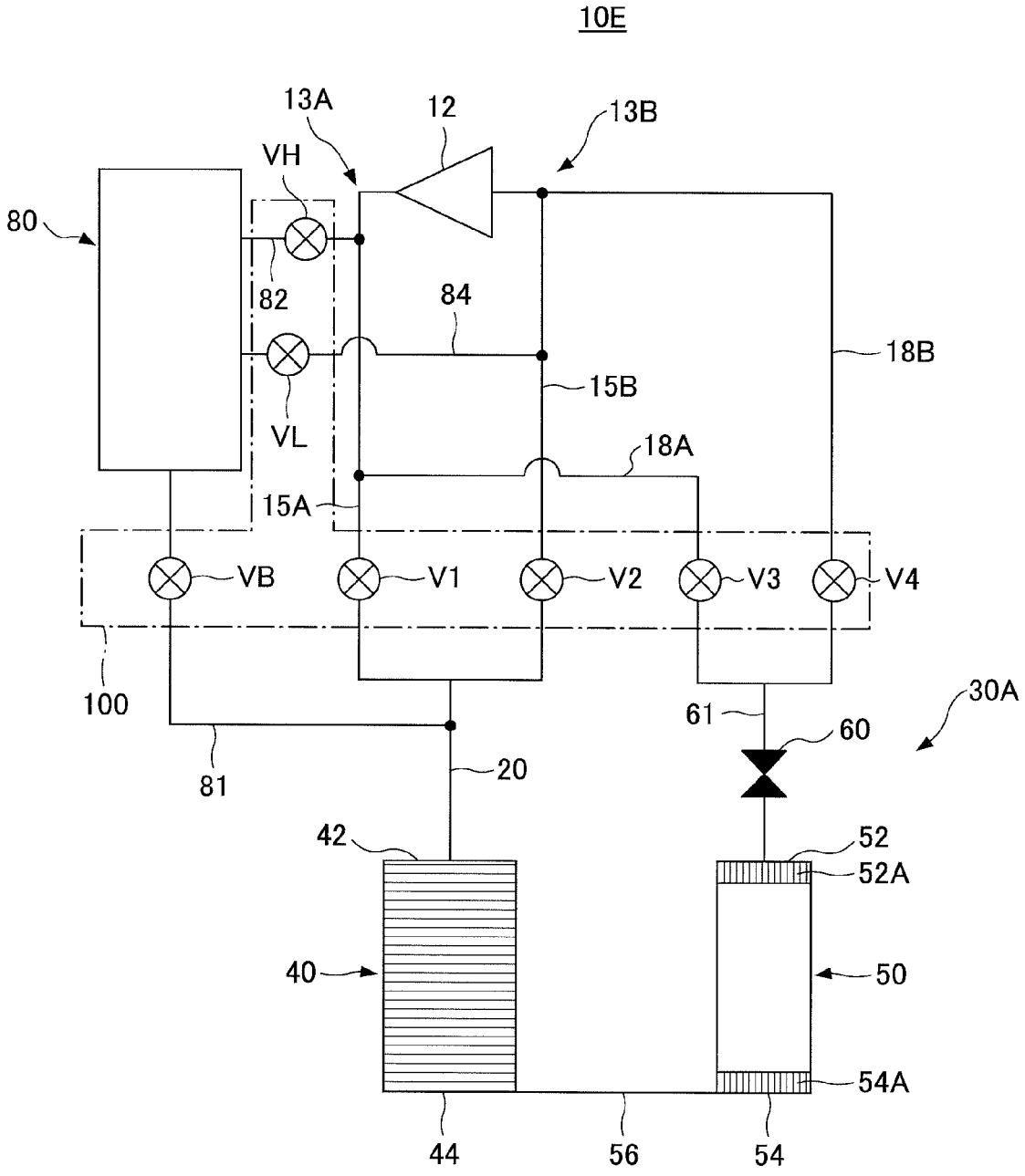
FIG. 8 is a diagram illustrating a cryogenic refrigerator according to a fifth embodiment of the present invention.

FIG. 8 is a diagram illustrating a cryogenic refrigerator 10E according to a fifth embodiment of the present invention.

The cryogenic refrigerator 10E of this embodiment is an application of an embodiment of the present invention to a pulse tube refrigerator of a four-valve type. Therefore, in addition to the configuration of the cryogenic refrigerator 10A of the first embodiment, the cryogenic refrigerator 10E of this embodiment includes a second high-pressure-side pipe 18A and a third opening and closing valve V3 in the high-pressure-side refrigerant gas feed system 13A; and a second low-pressure-side pipe 18B and a fourth opening and closing valve V4 in the low-pressure-side refrigerant gas collection system 13B.

The second high-pressure-side pipe 18A is provided between the first high-pressure-side pipe 15A and the pipe 61. Further, the third opening and closing valve V3 is provided in the second high-pressure-side pipe 18A. The second low-pressure-side pipe 18B is provided between the first low-pressure-side pipe 15B and the pipe 61. Further, the fourth opening and closing valve V4 is provided in the second low-pressure-side pipe 18B.

Figure 9:
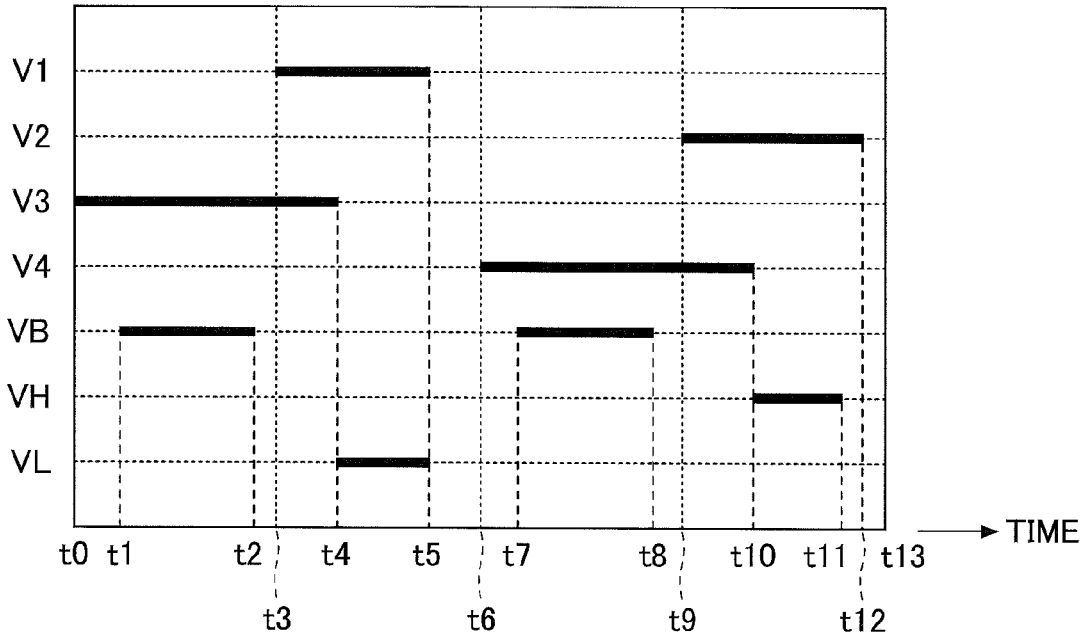
FIG. 9 is a timing chart illustrating opening and closing timing of valves of the cryogenic refrigerator according to the fifth embodiment of the present invention.
Figure 10:
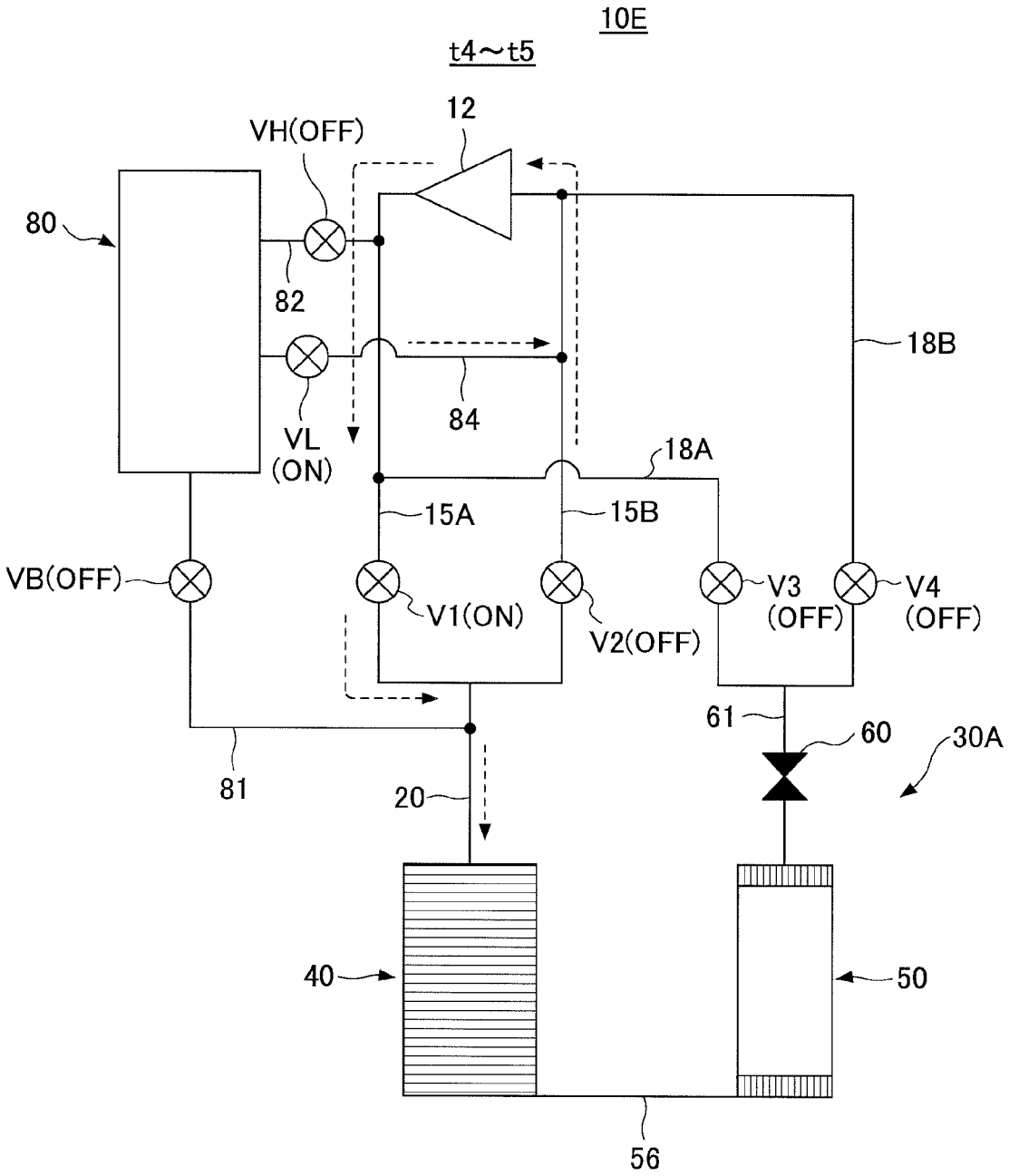
FIG. 10 is a diagram illustrating an operation of the cryogenic refrigerator according to the fifth embodiment of the present invention.
Figure 11:
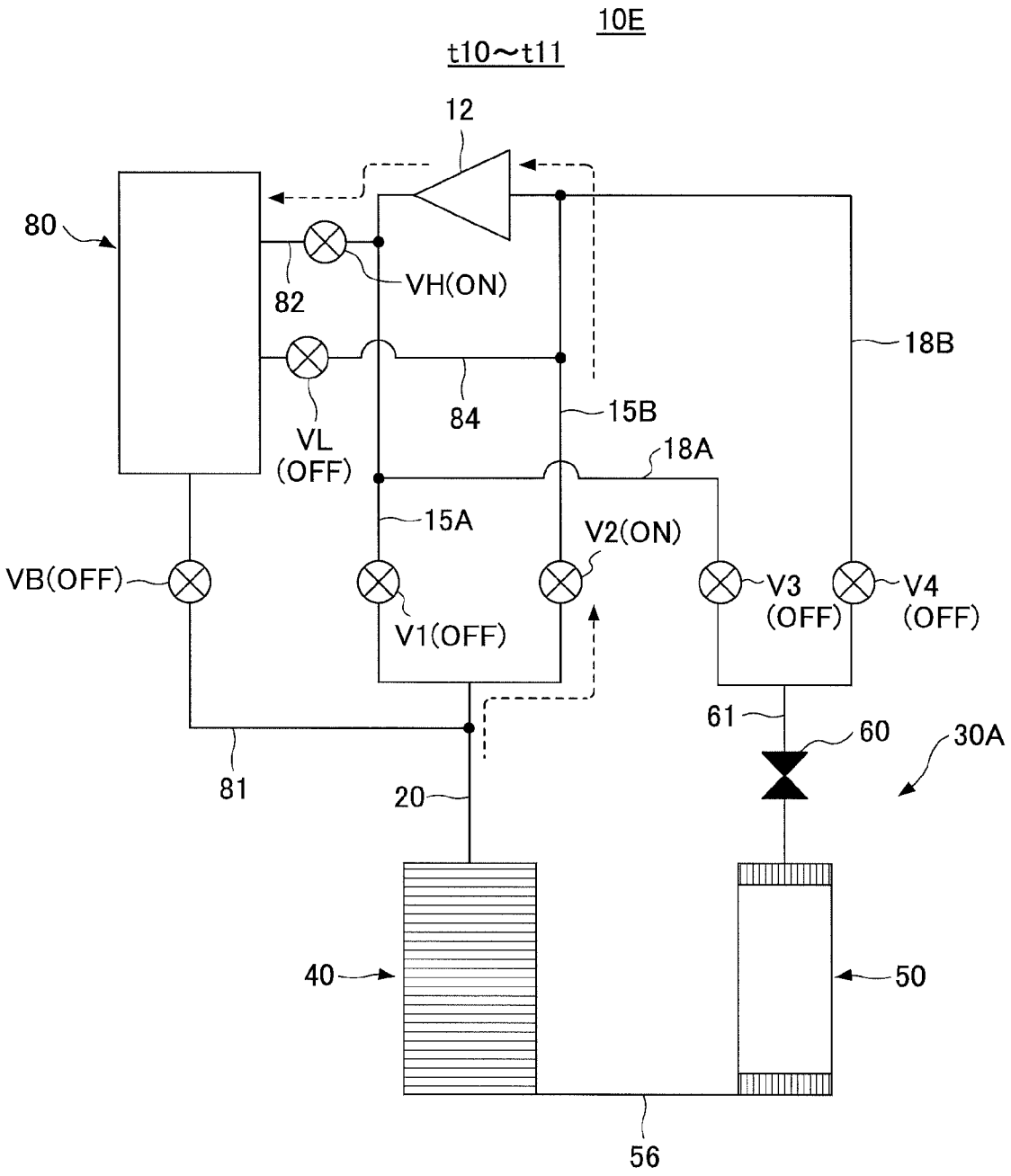
FIG. 11 is a diagram illustrating the operation of the cryogenic refrigerator according to the fifth embodiment of the present invention.

Next, a description is given, with reference to FIG. 9 through FIG. 11, of an operation of the cryogenic refrigerator 10E of the above-described configuration.

FIG. 9 is a timing chart illustrating opening and closing timing of the valves V1 through V4, VB, VH, and VL provided in the cryogenic refrigerator 10A. FIG. 10 is a diagram illustrating a state of the cryogenic refrigerator 10E between Time t4 and Time t5 in FIG. 9. FIG. 11 is a diagram illustrating a state of the cryogenic refrigerator 10E between Time t10 and Time t11 in FIG. 9.

The cryogenic refrigerator 10E includes the valve unit 100. The valve unit 100 includes the valves V1 through V4, VB, VH, and VL, and controls the switching (opening and closing) of the valves V1 through V4, VB, VH, and VL. The valve unit 100 may be configured by a controller and electromagnetic valves (corresponding to the valves V1 through V4, VB, VH, and VL) or by a rotary valve that implements the valves V1 through V4, VB, VH, and VL. For convenience of graphical representation, the valve unit 100 is not indicated in FIG. 10 and FIG. 11.

In FIG. 9, a period indicated by a bold solid line indicates the open state of a valve. Further, in FIG. 10 and FIG. 11, an open valve is indicated by "(ON)" and a closed valve is indicated by "(OFF)."

[First Process: Time t0 through Time t3]

As illustrated in FIG. 9, first, only the third opening and closing valve V3 is opened. This causes a high-pressure refrigerant gas to be fed from the compressor 12 to the pulse tube 50 through the first high-pressure-side pipe 15A, the second high-pressure-side pipe 18A, and the pipe 61. The third opening and closing valve V3 remains open until Time t4.

The buffer valve VB is opened slightly after the opening of the third opening and closing valve V3, and is open from Time t1 to Time t2. The opening of the buffer valve VB causes a refrigerant gas inside the second buffer tank 80 to be fed to the regenerator 40 through the second common pipe 81 and the first common pipe 20.

[Second Process: Time t3 through Time t6]

Between Time t3 and Time t4, the third opening and closing valve V3 remains open. As a result, the high-pressure refrigerant gas is kept being fed from the compressor 12 to the pulse tube 50 through the same flow passage as in the first process.

Further, in the second process, the first opening and closing valve V1 is opened from Time t3 to Time t5. The opening of the first opening and closing valve V1 causes the high-pressure refrigerant gas generated in the compressor 12 to be fed to the regenerator 40 through the first high-pressure-side pipe 15A and the first common pipe 20.

According to the cryogenic refrigerator 10E of this embodiment, a high-pressure refrigerant gas is fed from the second buffer tank 80 to the regenerator 40 between Time t1 and Time t2 before the feeding of a high-pressure refrigerant gas from the compressor 12 to the regenerator 40. Therefore, it is possible to reduce the amount of gas fed from the compressor 12 to the regenerator 40, so that it is possible to reduce the output and the power consumption of the compressor 12.

Meanwhile, the low-pressure-side valve VL is opened a predetermined time later than the opening of the first opening and closing valve V1, and is open from Time t4 to Time t5.

In the low-pressure-side refrigerant gas collection system 13B (FIG. 8), the second and fourth opening and closing valves V2 and V4 are closed, and the compressor 12 collects a low-pressure refrigerant gas from the first and second low-pressure-side pipes 15B and 18B and feeds the collected refrigerant gas to the high-pressure-side refrigerant gas feed system 13A. As a result, the pressure inside the first and second low-pressure-side pipes 15B and 18B is reduced. Therefore, leaving this state would result in an increase in the pressure difference between the high-pressure side and the low-pressure side of the compressor 12 as in the conventional case.

However, according to the cryogenic refrigerator 10E of this embodiment, the second buffer tank 80 and the first low-pressure-side pipe 15B are connected by the low-pressure-side bypass pipe 84. Further, the low-pressure-side valve VL provided in the low-pressure-side bypass pipe 84 is opened at Time t4 after passage of a predetermined time since the opening of the first opening and closing valve V1 as illustrated in FIG. 9.

Therefore, the low-pressure-side valve VL is opened from Time t4 to Time t5 to cause a high-pressure refrigerant gas in the second buffer tank 80 to flow into the first low-pressure-side pipe 15B through the low-pressure-side bypass pipe 84 as illustrated in FIG. 10 (in which a broken line arrow indicates a flow of a refrigerant gas).

Accordingly, even with the compressor 12 collecting a refrigerant gas from the first and second low-pressure-side pipes 15B and 18B, a high-pressure refrigerant gas is fed from the second buffer tank 80 to the first low-pressure-side pipe 15B to prevent the pressure inside the first and second low-pressure-side pipes 15B and 18B from being reduced.

[Third Process: Time t6 through Time t9]

Between Time t6 and Time t9, the fourth opening and closing valve V4 remains open. As a result, the refrigerant gas inside the pulse tube 50 is collected into the compressor 12 through the second low-pressure-side pipe 18B.

Further, between Time t7 and Time t8, the buffer valve VB is also open. As a result, the refrigerant gas inside the regenerator 40 is collected into the second buffer tank 80 through the first common pipe 20 and the second common pipe 81. This results in an increase in the pressure of the refrigerant gas inside the second buffer tank 80.

[Fourth Process: Time t9 through Time t13]

The fourth opening and closing valve V4 is closed at Time t10. Further, the second opening and closing valve V2 is opened from Time t9 to Time 12. The opening of the second opening and closing valve V2 causes the refrigerant gas inside the regenerator 40 and the pulse tube 50 to be collected into the compressor 12 through the connecting pipe 56, the regenerator 40, the first common pipe 20, and the first low-pressure-side pipe 15B. As a result, between Time t9 and Time t10, the refrigerant gas is collected into the compressor 12 using both the first low-pressure-side pipe 15B and the second low-pressure-side pipe 18B.

As described above, according to the cryogenic refrigerator 10E of this embodiment, the refrigerant gas is collected into the second buffer tank 80 before the compressor 12 starts to collect the refrigerant gas from the pulse tube 50 and the regenerator 40. Therefore, compared with the case of collecting a refrigerant gas only with the compressor 12, it is possible to reduce the amount of gas collected with the compressor 12, so that it is possible to reduce the output and the power consumption of the compressor 12.

The refrigerant gas collected through the first and second low-pressure-side pipes 15B and 18B is compressed in the compressor 12, so that the high-pressure refrigerant gas is fed to the first high-pressure-side pipe 15A.

In the high-pressure-side refrigerant gas collection system 13A (FIG. 8), the first and third opening and closing valves V1 and V3 are closed, and the compressor 12 collects a low-pressure refrigerant gas from the first and second low-pressure-side pipes 15B and 18B and feeds the collected refrigerant gas to the high-pressure-side refrigerant gas feed system 13A. As a result, the pressure inside the first and second high-pressure-side pipes 15A and 18A increases. Therefore, leaving this state would result in an increase in the pressure difference between the high-pressure side and the low-pressure side of the compressor 12 as described above.

However, according to the cryogenic refrigerator 10E of this embodiment, the second buffer tank 80 and the first high-pressure-side pipe 15A are connected by the high-pressure-side bypass pipe 82. Further, the high-pressure-side valve VH provided in the high-pressure-side bypass pipe 82 is opened at Time t10 after passage of a predetermined time since the opening of the second opening and closing valve V2 as illustrated in FIG. 9.

Therefore, the high-pressure-side valve VH is opened from Time t10 to Time t11 to cause the high-pressure refrigerant gas generated in the compressor 12 to flow into the second buffer tank 80 through the high-pressure-side bypass pipe 82 as illustrated in FIG. 11 (in which a broken line arrow indicates a flow of a refrigerant gas). Accordingly, even with the compressor 12 feeding a high-pressure refrigerant gas to the first high-pressure-side pipe 15A with the first and third opening and closing valves V1 and V3 closed, the high-pressure refrigerant gas is fed to the second buffer tank 80 to prevent the pressure inside the first and second high-pressure-side pipes 15A and 18A from increasing.

According to the cryogenic refrigerator 10E of this embodiment as well, by repeatedly performing the above-described first through fourth processes as one cycle, a refrigerant gas is repeatedly compressed and expanded in the pulse tube 50, so that it is possible to produce cold temperatures at the low-temperature end 54 of the pulse tube 50.

Further, like the cryogenic refrigerator 10A according to the first embodiment, the cryogenic refrigerator 10E also makes it possible to prevent the pressure of the high-pressure-side refrigerant gas feed system 13A on the high-pressure side of the compressor 12 from increasing in a period during which no refrigerant gas is fed from the compressor 12 to the refrigerator body 30A, and to prevent the pressure of the compressor 12 from being reduced in a period during which no refrigerant gas is collected from the refrigerator body 30A by the compressor 12. As a result, it is possible to reduce a pressure difference between the high-pressure side and the low-pressure side of the compressor 12, so that it is possible to reduce the power consumption of the compressor 12 and to improve the refrigeration efficiency of the refrigerator body 30A.

The opening and closing timing of valves illustrated in FIG. 2 and the opening and closing timing of valves illustrated in FIG. 9 are non-limiting examples of the opening and closing timing of valves according to embodiments of the present invention. The opening and closing timing of valves according to embodiments of the present invention may be suitably changed.

According to an aspect of the present invention, a cryogenic refrigerator is allowed to feed a high-pressure refrigerant gas from a high-pressure-side pipe to a buffer tank by opening a high-pressure-side valve in a period during which no refrigerant gas is fed from a compressor to a cylinder or the like. Further, the cryogenic refrigerator is allowed to feed a high-pressure refrigerant gas inside the buffer tank to a low-pressure-side pipe by opening a low-pressure-side valve in a period during which no refrigerant gas is collected from the cylinder or the like to the compressor. As a result, it is possible to reduce a pressure difference between the high-pressure side and the low-pressure side of the compressor.

All examples and conditional language provided herein are intended for pedagogical purposes of aiding the reader in understanding the invention and the concepts contributed by the inventor to further the art, and are not to be construed as limitations to such specifically recited examples and conditions, nor does the organization of such examples in the specification relate to a showing of the superiority or inferiority of the invention. Although one or more embodiments of the present invention have been described in detail, it should be understood that the various changes, substitutions, and alterations could be made hereto without departing from the spirit and scope of the invention.

What is claimed is:

1. A cryogenic refrigerator, comprising:

a regenerator filled with a regenerator material;

a compressor connected to a first pipe for feeding a refrigerant gas of a first pressure to the regenerator, and connected to a second pipe for collecting the refrigerant gas of a second pressure lower than the first pressure from the regenerator;

a third pipe having a first end connected to a connection of the first pipe and the second pipe and a second end connected to a high-temperature end of the regenerator;

a buffer tank configured to store the refrigerant gas;

a first opening and closing valve provided in the first pipe;

a second opening and closing valve provided in the second pipe;

a first valve provided in a first connecting pipe extending from the buffer tank to bypass the first opening and closing valve and the second opening and closing valve to connect to the third pipe;

a second valve provided in a second connecting pipe extending from the buffer tank to connect to the first pipe; and a third valve provided in a third connecting pipe extending from the buffer tank to connect to the second pipe, wherein the third valve is opened at a first time and remains opened until a second time at which the third valve is closed, the first opening and closing valve remains open from the first time to the second time, and each of the first valve and the second valve remains closed from the first time to the second time.

2. The cryogenic refrigerator as claimed in claim 1, wherein the first connecting pipe connects to an intermediate portion of the third pipe between the first end and the second end thereof.

3. The cryogenic refrigerator as claimed in claim 1, wherein the second valve is configured to be opened to allow the refrigerant gas to flow from the first pipe to the buffer tank through the second valve, and the third valve is configured to be opened to allow the refrigerant gas to flow from the buffer tank to the second pipe through the third valve.

* * * * *